US008534005B2

(12) United States Patent
Thomas et al.

(10) Patent No.: US 8,534,005 B2
(45) Date of Patent: Sep. 17, 2013

(54) ADJUSTABLE AND REVERSIBLE PILLAR

(76) Inventors: Charles Frederick Thomas, Kelowna (CA); Cameron Kent West, Kelowna (CA)

( * ) Notice: Subject to any disclaimer, the term of this patent is extended or adjusted under 35 U.S.C. 154(b) by 0 days.

(21) Appl. No.: 13/482,547

(22) Filed: May 29, 2012

(65) Prior Publication Data

US 2012/0279146 A1 Nov. 8, 2012

Related U.S. Application Data

(63) Continuation-in-part of application No. 12/656,811, filed on Feb. 17, 2010, now abandoned.

(51) Int. Cl.

| | |
|---|---|
| ***E06B 11/06*** | (2006.01) |
| ***E04C 3/30*** | (2006.01) |
| ***E05D 7/02*** | (2006.01) |
| ***E05D 7/04*** | (2006.01) |

(52) U.S. Cl.
USPC ..... 52/126.4; 52/296; 49/49; 16/86.1; 16/236; 256/DIG. 5

(58) Field of Classification Search
USPC ..... 49/49, 226, 381; 16/236, 237, 248, 16/86.1; 52/126.4, 126.7, 169.13, 170, 165, 52/296, 297; 248/156, 530; 256/65.17, 73, 256/DIG. 5
See application file for complete search history.

(56) References Cited

U.S. PATENT DOCUMENTS

| | | | | |
|---|---|---|---|---|
| 495,291 | A | | 4/1893 | Barnes |
| 611,568 | A | | 9/1898 | Dohme |
| 1,234,893 | A | | 7/1917 | Fridley |
| 1,237,837 | A | | 8/1917 | Sundh |
| 1,537,420 | A | * | 5/1925 | Doddridge ..... 16/236 |
| 1,540,490 | A | | 6/1925 | Mertel |
| 1,794,467 | A | | 3/1931 | Lucas |
| 2,647,593 | A | | 8/1953 | Holman |
| 2,690,326 | A | | 9/1954 | Kranick |
| 4,218,858 | A | | 8/1980 | Legler |
| 4,242,822 | A | | 1/1981 | Black |
| 4,455,795 | A | | 6/1984 | Cole |
| 4,543,757 | A | | 10/1985 | Cosgrove |
| 4,603,520 | A | | 8/1986 | Deike |
| 4,665,650 | A | | 5/1987 | Hall |
| 4,703,600 | A | | 11/1987 | Suh |
| 4,815,713 | A | | 3/1989 | Schmanski |
| 4,858,876 | A | | 8/1989 | Moreno |
| 4,874,149 | A | | 10/1989 | Miceli |
| 4,923,164 | A | | 5/1990 | Stenberg |
| 4,995,590 | A | | 2/1991 | Close |
| 5,035,082 | A | | 7/1991 | Butler |
| 5,050,828 | A | | 9/1991 | Wolff |
| 5,123,623 | A | | 6/1992 | McNamara |

(Continued)

*Primary Examiner* — Robert Canfield
(74) *Attorney, Agent, or Firm* — Antony C. Edwards

(57) ABSTRACT

An adjustable and reversible pillar includes a reversible substantially rectangular parallelepiped pillar housing resting on a base. The first and second ends have corresponding first and second mounting flanges extending therearound. The housing is hollow. The mounting flanges each extend inwardly of the walls and into the cavity. Either of the first or seconds ends is adapted for mounting on the base. At least one of the housing walls is selectively removable. At least the upper surface of the base is sized to mate with the first or second ends of the pillar housing by mounting of the corresponding first or second mounting flanges onto the upper surface of base. Vertically adjustable feet are mounted to the lower surface of the base.

11 Claims, 14 Drawing Sheets

(56) References Cited

U.S. PATENT DOCUMENTS

| | | | | |
|---|---|---|---|---|
| 5,133,164 | A | 7/1992 | Legler | |
| 5,197,248 | A | 3/1993 | Kruse | |
| 5,203,817 | A | 4/1993 | Klumpjan | |
| 5,359,827 | A | 11/1994 | Gehman | |
| 5,373,664 | A | 12/1994 | Butler | |
| 5,625,988 | A | 5/1997 | Killick | |
| 5,901,525 | A | 5/1999 | Doeringer et al. | |
| 5,960,601 | A | 10/1999 | Offutt | |
| 6,244,221 | B1 | 6/2001 | Kleinsasser | |
| 6,401,411 | B1 | 6/2002 | Maglio, Jr. | |
| 6,409,419 | B1 | 6/2002 | Hernandez | |
| 6,611,992 | B1 * | 9/2003 | Arnaud | 16/239 |
| 6,886,296 | B1 | 5/2005 | John et al. | |
| 7,155,779 | B2 | 1/2007 | Watkins | |
| 7,191,573 | B1 | 3/2007 | Newton, II | |
| 7,325,790 | B2 | 2/2008 | Lee | |
| 7,367,161 | B1 | 5/2008 | Jones | |
| 7,988,035 | B2 | 8/2011 | Cox et al. | |
| 2005/0252146 | A1 | 11/2005 | MacDonald et al. | |
| 2006/0016046 | A1 * | 1/2006 | Koert et al. | 16/86.1 |
| 2006/0201087 | A1 | 9/2006 | Cutforth | |
| 2007/0101649 | A1 | 5/2007 | Anderson et al. | |
| 2007/0125022 | A1 | 6/2007 | Cutforth | |
| 2010/0025650 | A1 * | 2/2010 | Chung | 256/65.14 |

* cited by examiner

FIG 12a
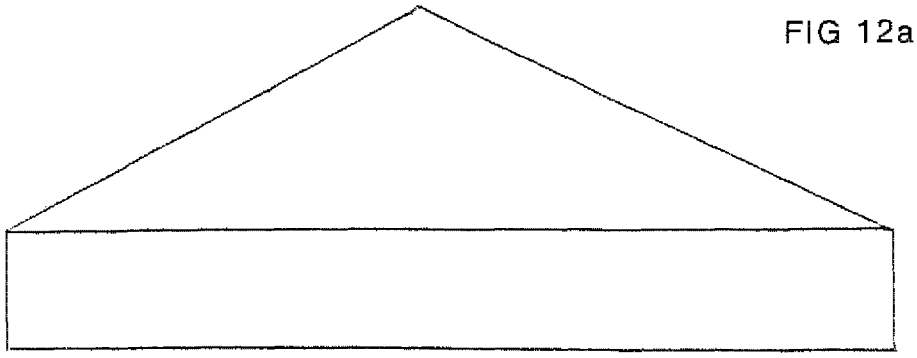
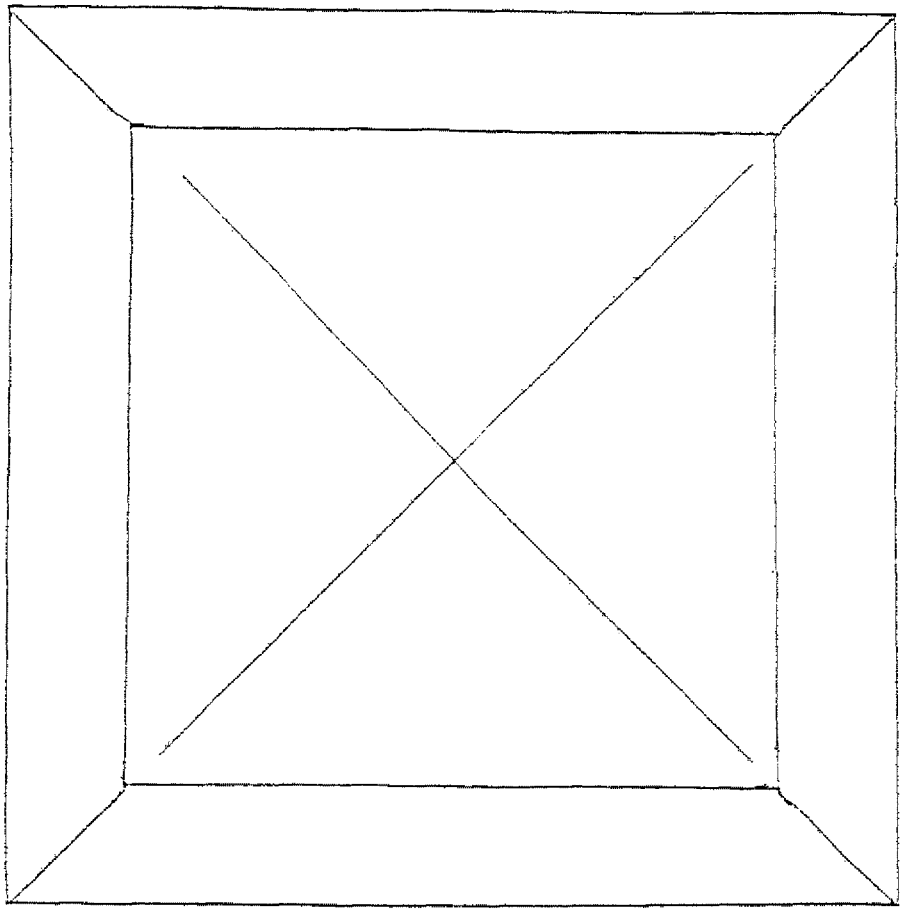
FIG 12b

ADJUSTABLE AND REVERSIBLE PILLAR

CROSS REFERENCE TO RELATED APPLICATION

This application is a Continuation-in-Part from U.S. patent application Ser. No. 12/656,811 filed Feb. 17, 2010 entitled Adjustable Pillar.

FIELD OF THE INVENTION

This invention relates to the field of pillars including pillars which are adapted for supporting the weight of a fence, gate or the like, and in particular to an adjustable and reversible pillar which, while being well adapted for bearing the weight of a fence panel, gate, or the like, is adjustable to accommodate alignment irregularities upon the forming of the pillar foundation or otherwise upon mounting of the pillar onto an uneven surface so that the pillar's pillar box may be aligned vertically, and is also reversible to position hinges on the pillar where they are required.

BACKGROUND OF THE INVENTION

It is conventional that weight hearing pillars for supporting fence panels, gates or the like must not only be weight bearing structures but also well affixed to the ground by a foundation or like sub-structure or by mounting onto a base which is affixed to the ground so as to resist, especially in the case of gates, the bending moment imparted to the pillar by the cantilevered weight of the gate acting on the pillar so as to pull the pillar out of vertical alignment.

The sub-structure supporting such pillars in order to resist the bending moment is often a foundation which is formed so as to be buried in the ground under the pillar, for example a foundation of poured concrete. In applicant's experience often the pillar itself is bolted down onto the concrete of the foundation so that, if the foundation is mis-aligned, that is for example if the top of the foundation footing is not horizontal, the pillar when mounted onto the foundation will not be vertical. Even relatively slight mis-alignment from the horizontal of the foundation footing will often cause visually perceptible mis-alignment from the vertical of the pillar due to the fact that the pillars are often quite tall and narrow and thus a small degree of off-set of the foundation footing from horizontal results in a visually perceptible mis-alignment of the pillars from the vertical.

In the past, correcting the alignment of the pillar which is to be mounted onto a somewhat non-horizontal foundation provides difficulties and is laborious for the installer of the pillar, who has to employ shims or the like, keeping in mind that the weight being born by the pillar is often substantial and thus the shims employed to bring the pillar to vertical must be capable of withstanding a great load over the lifetime of the pillar without shifting or breaking down. Further, in the past placement of the hinges in the most advantageous orientation was often difficult and time consuming.

In the prior art applicant is aware of U.S. Pat. No. 5,197,248 which issued to Kruse are Mar. 30, 1993 for a Pre-Fabricated Column Assembly. Kruse teaches installing a gate column by boring a hole in the ground and filling the hole with concrete to form the footing. Pipes are inserted into the concrete footing before it sets. Apertures are then cut through the wall of the tube forming the column on diametrically opposite sides of the tube to correspond to locations of bores which extend through a support pillar formed from the pipes. The tube is placed over the support pillar to rest on the footing and a threaded rod passed laterally through the bore in the support pillar. Threaded nuts are mounted onto the ends of the rod to fasten the tube onto the support pillar.

Applicant is also aware of U.S. Pat. No. 5,373,664 which issued to Butler on Dec. 20, 1994 for a Self-Contained Automatic Gate System. Butler discloses the construction of pillar footings by inserting a cardboard tube into a hole dug in the ground, positioning a plurality of vertical metal rods with spacers within the tube and pouring concrete into the tube leaving the upper threaded ends of the rods exposed. Once the concrete is hardened a bottom flange of the pillar is bolted to the rods to mount the gate assembly onto the footing. A metal collar may be provided about the top of the tube, with a flared upper end of the collar at ground level if the pillar is to be mounted below ground level. The footing is thus left exposed to the elements.

Applicant is also aware of U.S. Pat. No. 7,191,573 which issued to Newton on Mar. 20, 2007 for a Structural Pre-Fabricated Column Pillar for Securing to the Ground. Newton discloses a pre-fabricated column having rods which secure to the bottom of the column and a concrete form which is removably secured to the rods. A central tube is mounted in the column using support pans and is telescopically received within a receiver tube concreted into the ground. With the central tube mounted in the receiver tube, concrete is poured into the concrete form. Once the concrete cures, the form is removed and the ends of the rods plugged.

Applicant is also aware of U.S. Pat. No. 7,988,035, which issued Aug. 2, 2011 to Cox et al. for An Apparatus For Secure Postal And Parcel Receipt And Storage. Cox et al. disclose a housing having a compartment closed by a front door on the front of the receptacle. Mail is placed into the compartment via the door. The bottom or base portion of the receptacle includes a base and a plate. Both the plate and the base include holes into which the upper ends of J-bolts extend. Rubber washers/sleeves are mounted on the J-bolts within the holes in the base. The uppermost ends of the J-bolts are threaded and correspondingly threaded nuts are mounted onto the uppermost ends of the J-bolts so as to sandwich the rubber sleeves/washers between the nuts and the plate below the base so that by rotating the J-bolts, the nut is lowered so as to compress the rubber sleeves/washers thereby expanding the sleeves/washers to provide a pinch friction fit of the rubber sleeves/washers within the holes in the base. With the plate installed up against the underside of the base, the plate is set on the ground above a hole. Cement or concrete is poured into the hole and the lower ends of the J-bolts are sunk into the cement. After the cement hardens the base is placed onto the plate with the ends of the J-bolt sticking up through the holes in the base, and the washers, rubber sleeves and nuts are threaded onto the J-bolts to secure the base to the plate. The rubber sleeves expand when the nuts tightened on them. The tight fit of the holes around the extended rubber sleeves secures or affixes the base to the plate and to the J-bolts. Cox et al. teach that the base is secured only through the tight fit of the rubber sleeves and not otherwise fastened to the plate or J-bolts. Consequently, the orientation of the base relative to the plate may not be adjusted according to the mechanism of Cox et al., as compared to the adjustable mechanism provided in the base according to one aspect of the present invention wherein the angular orientation of the base relative to the bars extending upwardly from the foundation may be adjusted so as to orient the pillar to vertical when the ground surface is not horizontal.

SUMMARY OF THE INVENTION

The adjustable and reversible pillar according to one aspect of the present invention may be characterized as including a reversible substantially rectangular parallelepiped pillar housing resting on a base. The housing has opposite first and second ends which are substantially mirror images of one another. The first and second ends have corresponding first and second mounting flanges extending therearound. The housing is hollow, having a cavity therein defined by pillar walls extending longitudinally between the first and second ends of the pillar. The mounting flanges each extend inwardly of the walls and into the cavity. Either of the first or seconds ends is adapted for mounting on the base. At least one of the housing walls is selectively removable from the housing to provide access into the cavity when removed from the housing. The base has substantially parallel upper and lower surfaces. At least the upper surface of the base is sized to mate with the first or second ends of the pillar housing by mounting of the corresponding first or second mounting flanges onto the upper surface of base. Vertically adjustable feet are mounted to the lower surface of the base. A vertically adjustable hinge mounting assembly is mounted to or formed in one of the walls.

The mounting flanges each have a plurality of mounting holes spaced theraround. The base has a corresponding plurality of ground anchor holes spaced around the base so as to cooperate with the plurality of mounting holes for journaling of ground anchors therethrough whereby upper ends of the ground anchors are securable down against the corresponding mounting flange when resting down onto the upper surface of the base to thereby secure the pillar housing down onto the base, and the base down onto the ground surface. The ground anchors protrude vertically upwardly from the ground.

The hinge mounting assembly may include at least one track formed and extending longitudinally along one of the pillar housing walls. The track may be a single vertical track.

Advantageously the upper surface of the base is substantially square, and a lateral cross-section through the first or second ends of the pillar housing is also square and substantially correspondingly sized for flush mounting of the first or second mounting flanges down onto the upper surface of the base. The housing is thereby selectively positionable about a longitudinally extending, centroidal axis of the housing, and is reversible end-for-end so as to mount either the first or the second ends of the housing on the base.

In a preferred embodiment the hinge mounting assembly is offset to one lateral side of one of the walls. For example, the hinge mounting assembly may be substantially along an edge of one of the walls, and may include a linear track for mounting hinges therein on hinge plates for selectively adjustable positioning therealong. The hinge plates are clamped towards the corresponding hinge by means of a bolt or the like so as to clamp the position of the hinge along the track.

The vertically adjustable feet may include vertically adjustable threaded male members such as bolts for mating into correspondingly threaded female members such as bolts mounted in or to the base.

Where the pillar according to the invention further includes ground anchors, for example in a pillar and mounting system, the ground anchors advantageously include rods having upper and lower ends, where the upper ends are threaded and the lower ends are adapted for mounting below ground level to provide anchoring to resist tipping of the housing. The upper ends of the rods journal upwardly through the anchor holes and mounting holes. Threaded nuts are threadably mountable onto and along the upper ends of the rods so as to clamp the nuts down onto the first or second mounting flange, whichever is the lower end, when resting on the upper surface of the base. Thus the first or second ends of the housing are clamped down onto the base and the feet of the base clamped down onto the ground surface.

In one embodiment the base may be hollow, having side walls, an open top, and at least a partially enclosed floor defining the lower surface of the base. The anchor holes in the lower surface of the base are formed in the base floor. The upper edges of the side walls form at least part of the upper surface of the base.

BRIEF DESCRIPTION OF THE DRAWINGS

FIG. 12*a* is, in side elevation view, the top cap of the pillar of FIG. 9.

FIG. 12*b* is, in plan view, the top cap of FIG. 12*a*.

DETAILED DESCRIPTION OF EMBODIMENTS OF THE INVENTION

Figure 1:
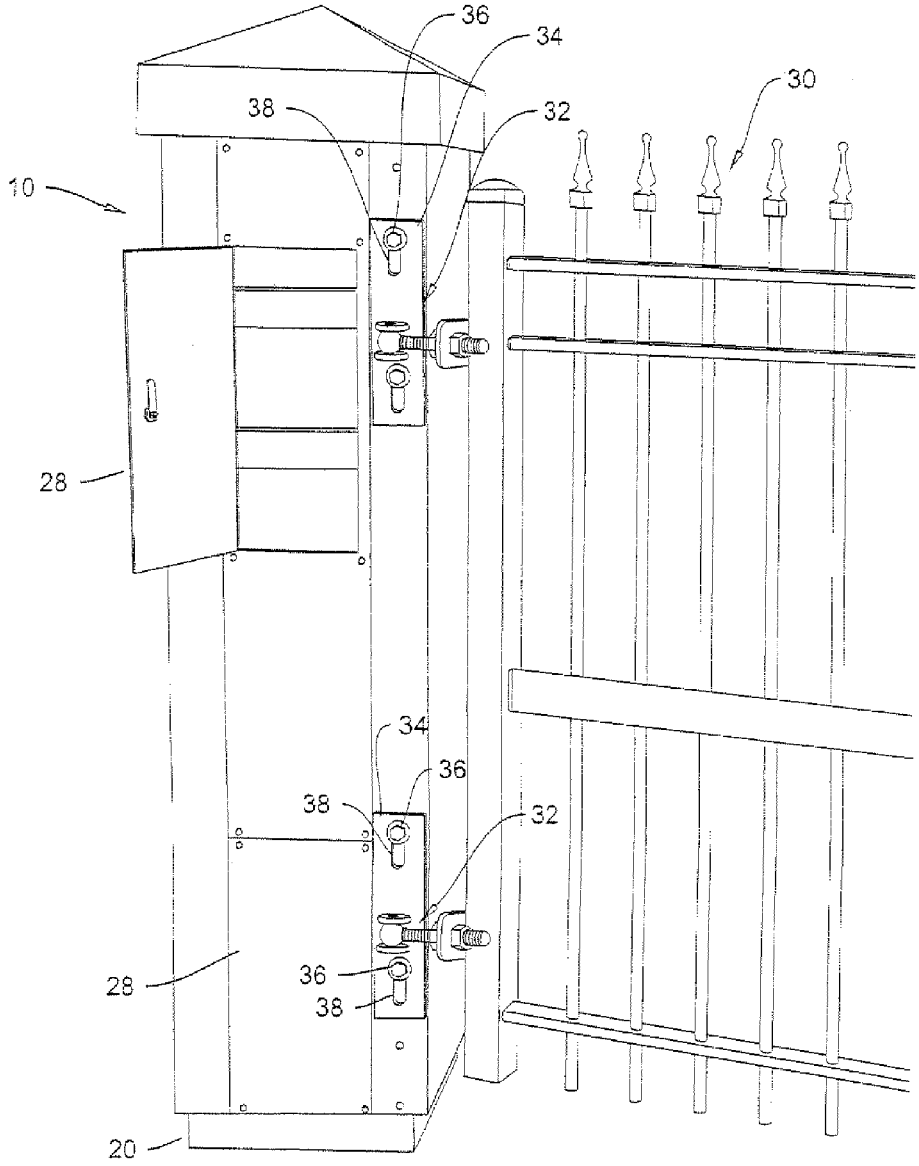
FIG. 1 is, in perspective view, one embodiment of the adjustable pillar of the present invention with a gate mounted thereto.

The modular pillar according to the present invention has a hollow housing or pillar box 10 which is vertically elongate and generally rectangular on side. Pillar box 10 has rectangular openings, namely upper and lower openings 10*a* and 10*b* respectively. Openings 10*a* and 10*b* may be rectangular and may be defined by sides 10*c*.

A circumferentially extending rigid flange or shelf 12 is formed circumferentially around the entire inner circumference of the cavity within pillar box 10. In one embodiment flange 12 is spaced upwardly from the lower opening 10*b* by approximately one quarter of the vertical length of pillar box 10. Apertures 12*a* are formed in the four corners of flange 12.

A foundation 14 may in one embodiment be provided which includes a frame of, for example, four vertically orientated rods 16 mounted to so as to extend vertically upward from a square base frame 18. Frame 18 may also for example be constructed of rods which have been cut to length and welded together at the corners. The lower most ends of rods 16 are also welded at the corners of base frame 18. Base frame 18 is sized so that, when rods 16 extend vertically upwards therefrom, the upper threaded ends 16*a* align with, so as to be journalled through apertures 12*a* in flange 12.

Ends 16*a* of rods 16 extend upwardly through a box form or base 20. Base 20 provides a box-like form around rods 16. Base 20 is sized so that it may nest within opening 10*b* so as to vertically telescope relative to the lower or base end of pillar box 10.

Figure 2:
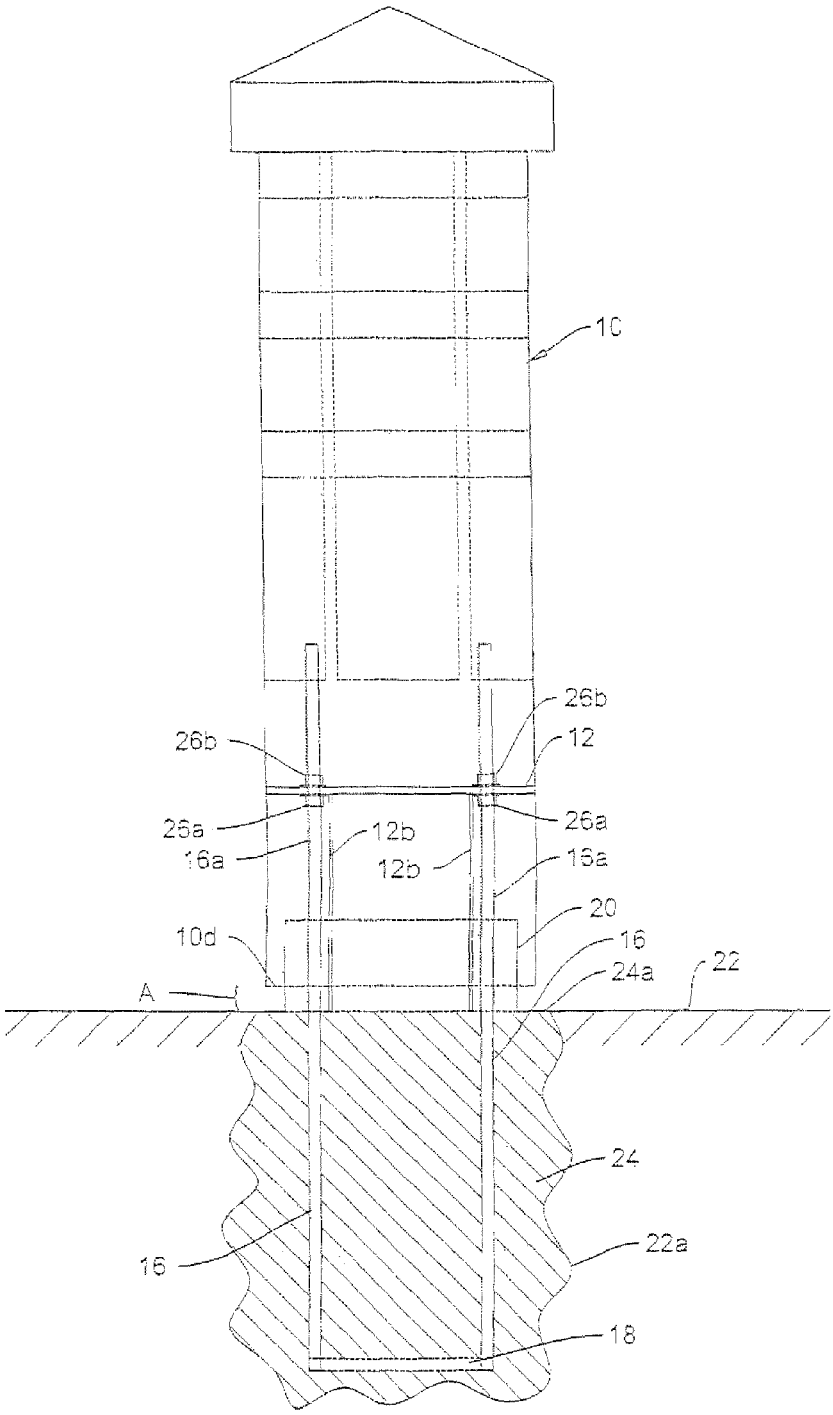
FIG. 2 is a cross-sectional view taken along a vertical plane vertically bisecting the pillar of FIG. 1.
Figure 3:
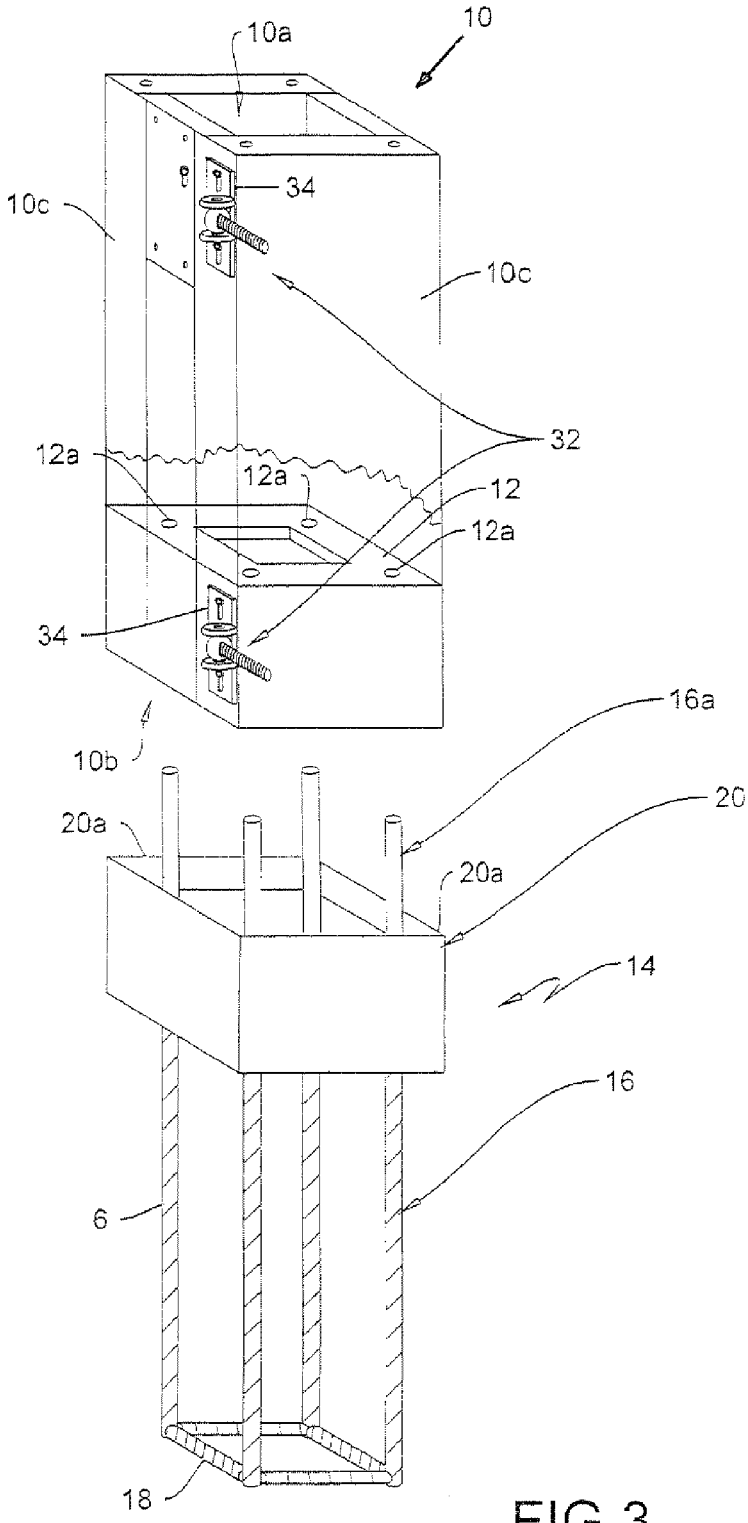
FIG. 3 is, in partially exploded partially cut-away perspective view, the foundation and pillar box of the adjustable pillar of FIG. 1.

During installation of the embodiment of FIG. 2, the ground 22 is excavated and base frame 18 and the lower portions of rods 16, below threaded ends 16*a* are lowered into the excavation. Rods 16 provide a reinforced footing when encased in concrete poured into the excavation. Base 20 is placed over threaded ends 16*a*. Threaded ends 16*a* are snugly bracketed in the corresponding corners 20*a* of base 20, and are thereby maintained in their vertical alignment above base frame 18.

With base 20 resting down onto the upper surface 24*a* of concrete 24 (or down onto ground 22 if concrete 24 has been covered over), lower threaded nuts 26*a* are threaded down onto threaded ends 16*a* and positioned at approximately the desired elevation of flange 12, that is, the elevation which corresponds to the desired spacing A of the lower most edge 10*d* of pillar box 10 above ground level. With lower nuts 26*a* in their desired position on threaded ends 16*a* (or at least in their approximate position), pillar box 10 is lowered down onto threaded ends 16*a* so as to journal threaded ends 16*a* through apertures 12*a* in flange 12. Flange 12 rests down against lower nuts 26*a*. Flange 12 may be supported by vertical ribs or bracket 12*b*.

Access panel 28 on the lower end of pillar box 10 is opened if not already open to as to provide access to the upper and lower sides of flange 12. Lower nuts 26*a* are adjusted on threaded ends 16*a* until the desired spacing A is achieved and pillar box 10 is vertical. Upper threaded nuts 26*b* are then threaded down onto threaded ends 16*a* so as to sandwich flange 12 between upper nuts 26*b* and lower nuts 26*a*. Flange 12, and thus pillar box 10, is thereby locked into place, vertically telescoped over base 20. The threaded ends 16*a* of rods 16, flange 12 and nuts 26*a*, 26*b* are protected from the weather by their location inside pillar box 10 and base 20.

In one embodiment, base 20 provides a form for pouring a concrete base or footing, in which case base 20 may be made of sheet metal which may be removed exposing the concrete footing. The concrete footing provides a rigid base supporting rods 16 and in particular supporting threaded ends 16*a*. In other embodiments, base 20 may itself be a rigid base, that is, is not replaced by a poured concrete footing.

In one embodiment, rods 16 are formed of so-called rebar, as is base frame 18. Threaded ends 16*a* are formed on the upper ends of the rebar so to accept nuts 26*a* and 26*b* in threaded mating thereon. The sides 10*c* of pillar box 10 may be made of sheet metal, as also may be access panels 28.

With pillar box 10 mounted onto foundation 14, and with foundation 14 encased in concrete 24 and entrenched in an excavation 22*a* in ground 22 pillar box 10 is well adapted to resist the bending moments acting on the pillar box as a result of gates 30 being hung from one side of pillar box 10 by gate hinges 32. Gate hinges 32 may be selectively actuable hinges which may be selectively actuated so as to open gates 30 by means of actuators such as gate openers 52 housed within pillar box 10.

Figure 4:
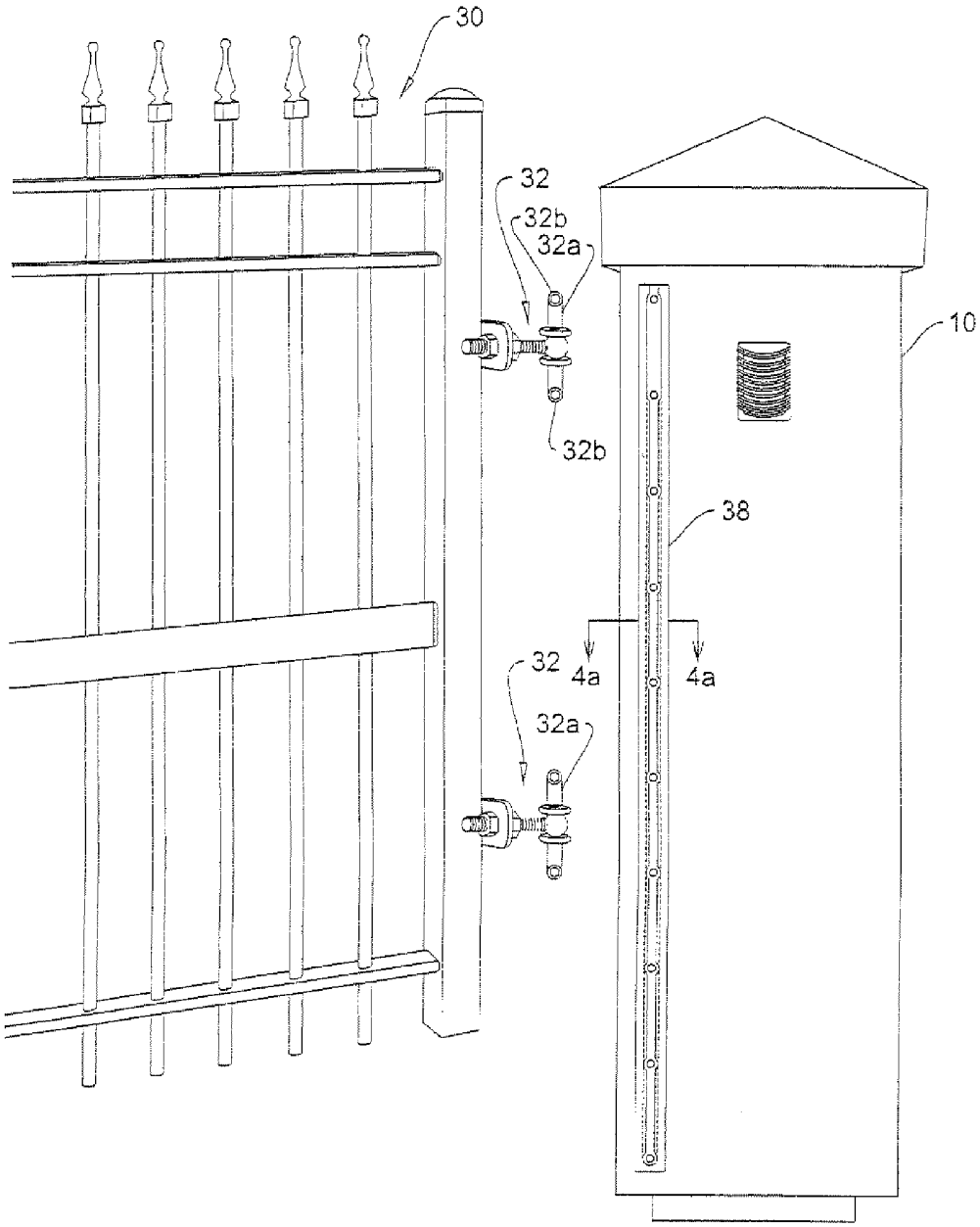
FIG. 4 is, in partially exploded view, the modular pillar and gate of FIG. 1 mounted by hinges according to a further embodiment.
Figure 4A:
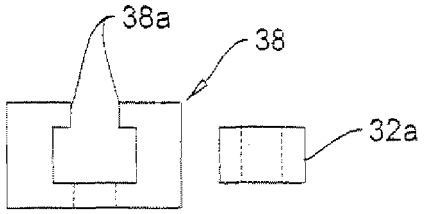
FIG. 4*a* is a sectional view along line 4*a*-4*a* in FIG. 4.

Hinges 32 may be mounted to pillar box 10 by various means. For example in the embodiment of FIG. 1, hinges 32 are rigidly mounted onto mounting plates 34 by means of bolts 36 mounted through adjustment slots 38. In the embodiment of FIG. 4, hinges 32 are mounted into channel 38 by means of slide plates 32*a* sliding along channel 38 while engaged under opposed facing retaining flanges 38*a*. Bolts 32*b* frictionally engage within channel 38 when hinges 32 are positioned at their desired height along channel 38.

Figure 5:
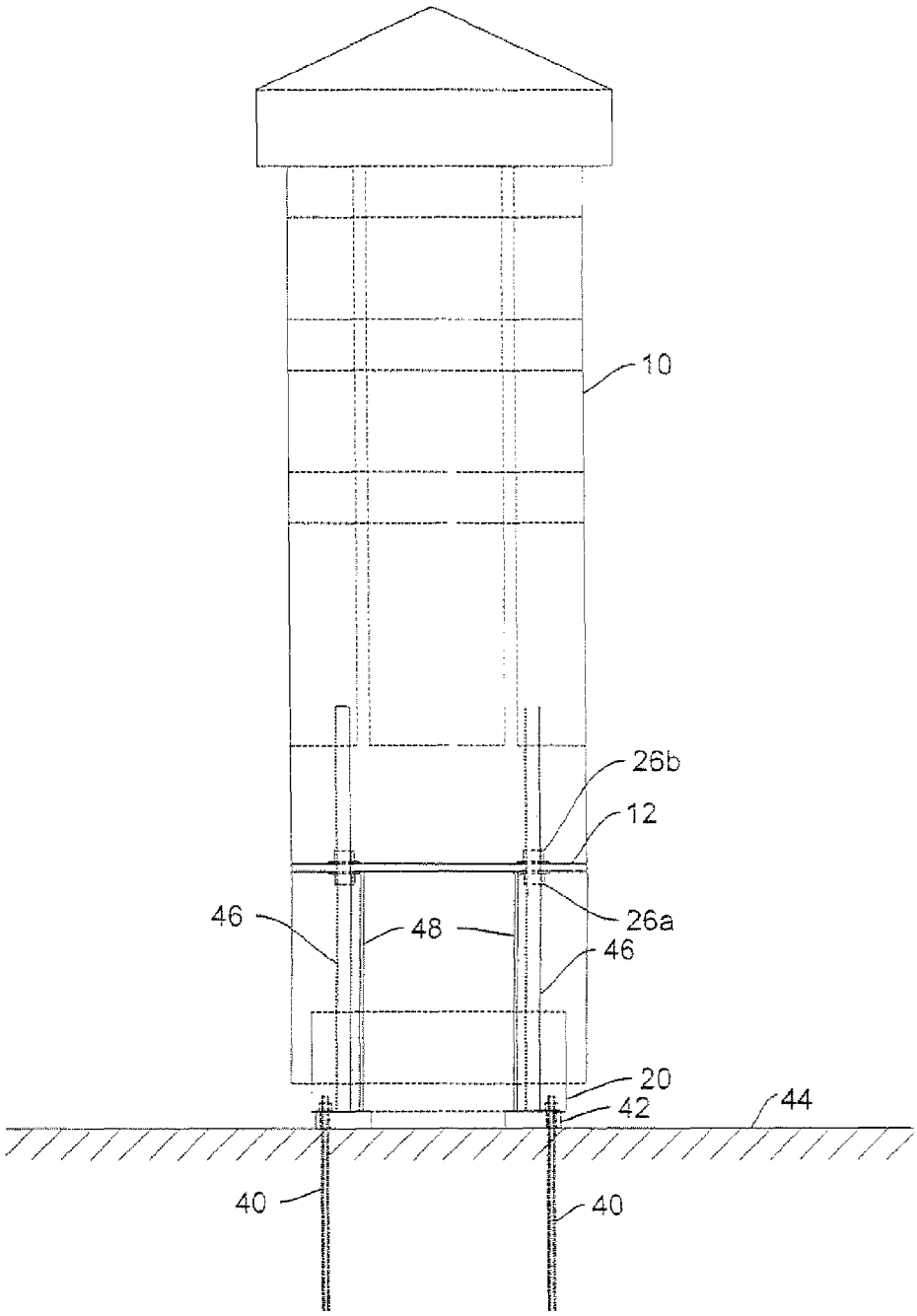
FIG. 5 is the view of FIG. 2 showing an alternative embodiment of adjustable foundation according to one aspect of the present invention.

In the embodiment of FIG. 5, threaded rods or bolts 40 are used to anchor a base plate 42 down onto a rigid surface such as a concrete slab 44. Box 20 is mounted down onto base plate 42. Threaded rods 46 are mounted to base plate 42 and extend vertically upwardly from base plate 42 through box 20 so as to be mounted to flange 12 through apertures 12*a* by means of upper and lower nuts 26*b* and 26*a* respectively as described above. As in the embodiment of FIG. 2, flange 12 may have vertical reinforcing ribs or plates 48 mounted thereunder.

Figure 6:
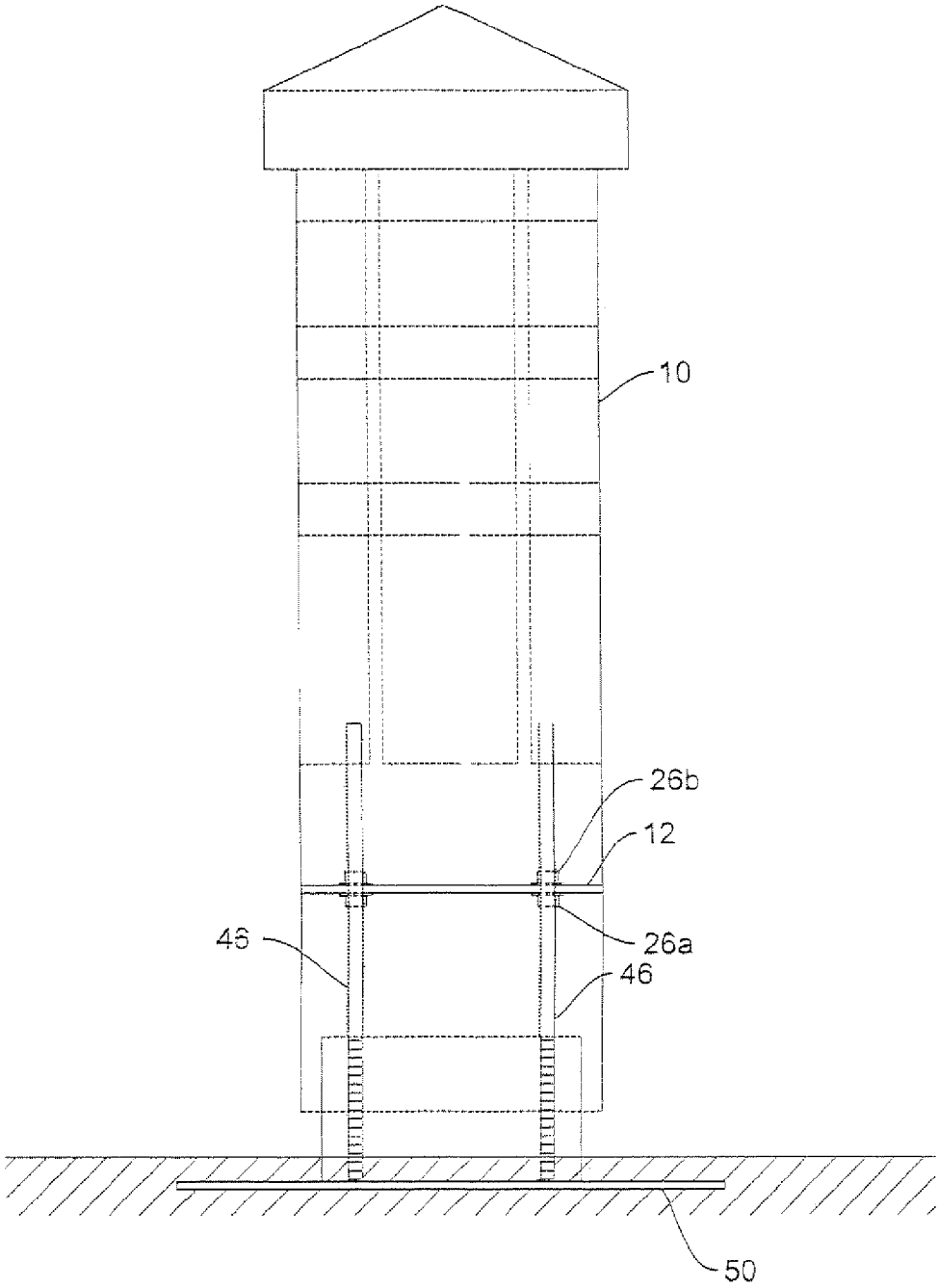
FIG. 6 is the view of FIG. 5 showing a further alternative embodiment of the adjustable foundation.

In the embodiment of FIG. 6, rods 46 are mounted down onto an underground supporting structure 50 buried in ground 22 or in slab 44. Supporting alternative 50 may be cross bars, rebar, plates etc. formed to extend laterally from the lower ends of rods 46 into the surrounding earth or slab to stabilize rods 46 when engaged with flange 12 by means of threaded couplers 26*a* and 26*b*, although other forms of couplers would also work (collectively referred to herein as threaded couplers).

Figure 7:
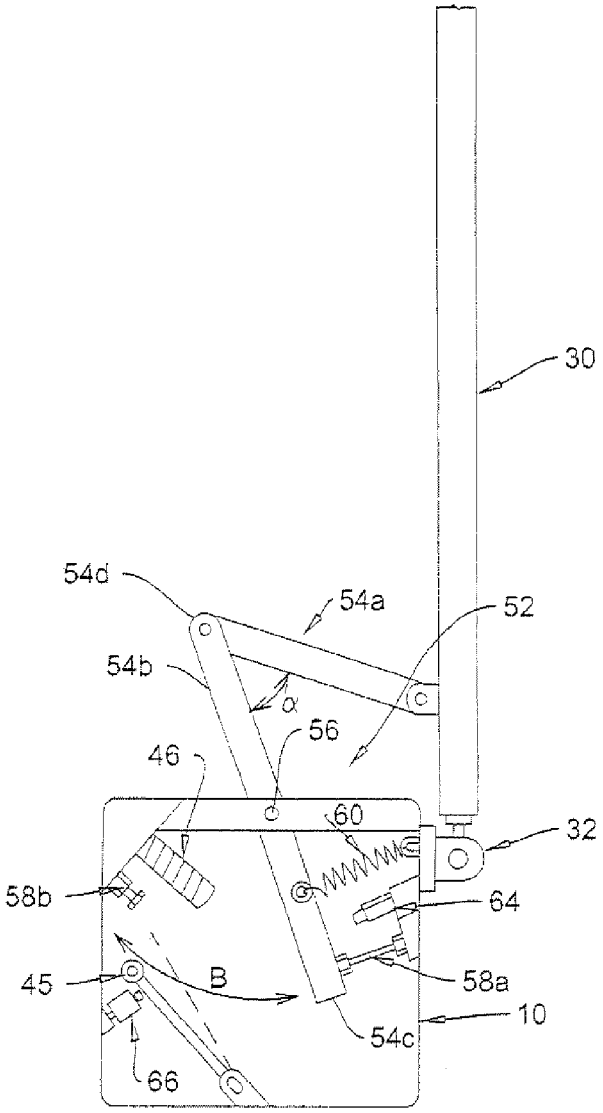
FIG. 7 is a sectional view horizontally through pillar box 10 so as to expose in plan view a semi-automatic gate opener mounted within the pillar box and cooperating with the gate by means of a pair of scissoring linkage arms.
Figure 8:
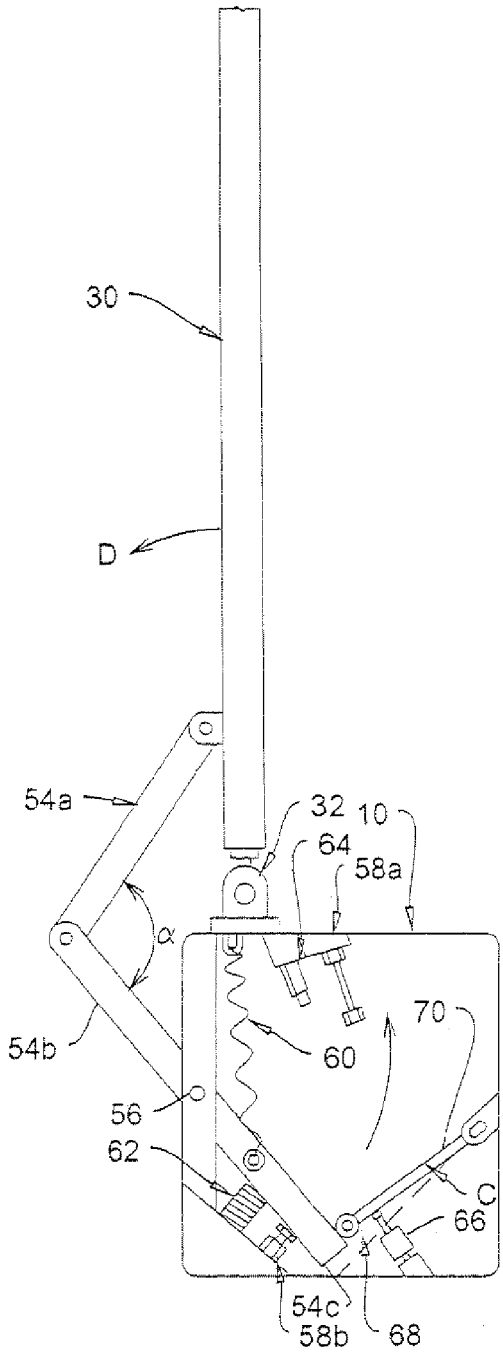
FIG. 8 is the gate opener of FIG. 7 with the gate in a position perpendicular to the position of the gate in FIG. 7.

As seen in FIGS. 7 and 8, a semi-automatic gate opener 52 may be mounted within pillar box 10 so as to cooperate with gate 30 for semi-automatic opening of gate 30. As seen in FIG. 7, with gate 30 at substantially a perpendicular orientation relative to its position shown in dotted outline, linkage arms 54*a* and 54*b* are pivoted so as to rotate the inner end 54*c* in direction B about hinge pin or shaft 56. Linkage arm 54*b* is pivotably mounted at its distal end 54*d* to linkage arm 54*a*, itself pivotally mounted at hinge 54*e* to gate 30. Stop 58*a* arrests rotation of end 54*c* in direction B as end 54*e* is rotated under the resilient urging, in tension, of spring 60.

In FIG. 8 gate 30 is perpendicular to the position of gate 30 in FIG. 7. Angle alpha (a) formed between linkage arms 54*a* and 54*b* is acute in FIG. 7 and obtuse in FIG. 8. In FIG. 8 end 54*c* of linkage arm 54*b* has been rotated in a direction opposite to direction B so as to engage against stop 58*b*. This compresses compression spring 62 and elongates tension spring 60. Hydraulic decelerator 64 may be provided adjacent stop 58*a* so as to decelerate end 54*e* prior to end 54*c* engaging against stop 58*a* under the urging of spring 60.

As also seen in FIG. 8, with end 54*c* of linkage arm 54*b* rotated against stop 58*b*, actuator 66 may be selectively actuated so as to swing roller lock 68 on the end of spring arm 70 in direction C. This engages roller lock 68 behind end 54*c* thereby locking end 54*c* against stop 58*b*. When it is desired to release the lock so as to allow tension spring 60 to rotate linkage arm 54*b* in direction B, to thereby rotate gate 30 in direction D, actuator 66 is retracted thereby pulling roller lock 68 clear of end 54*c*, that is, into the position illustrated in FIG. 7. Linkage arm 54*b* is then to swing in direction B.

Figure 9:
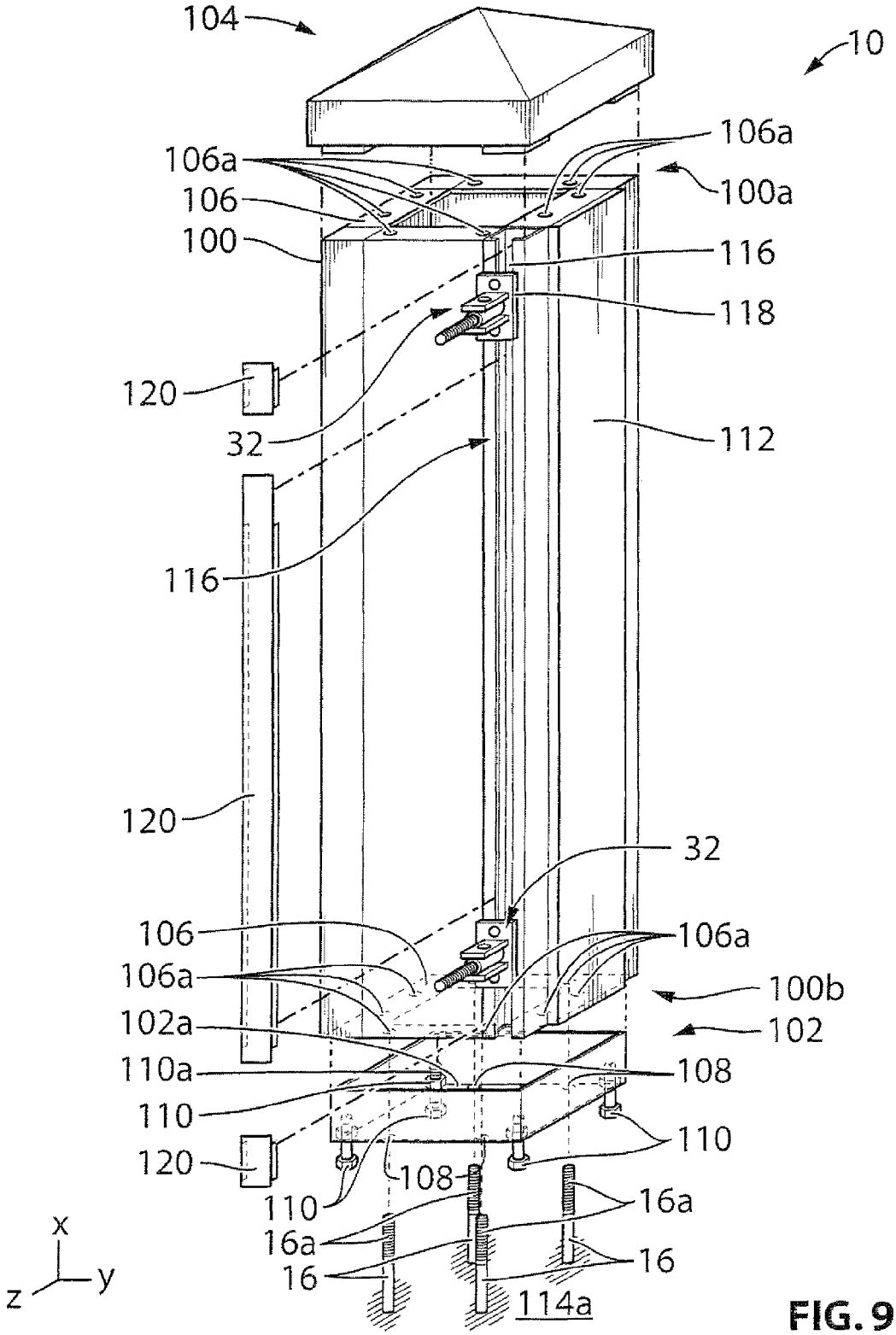
FIG. 9 is, in partially exploded top perspective view, the adjustable, reversible pillar according to one aspect of the present invention.
Figure 10:
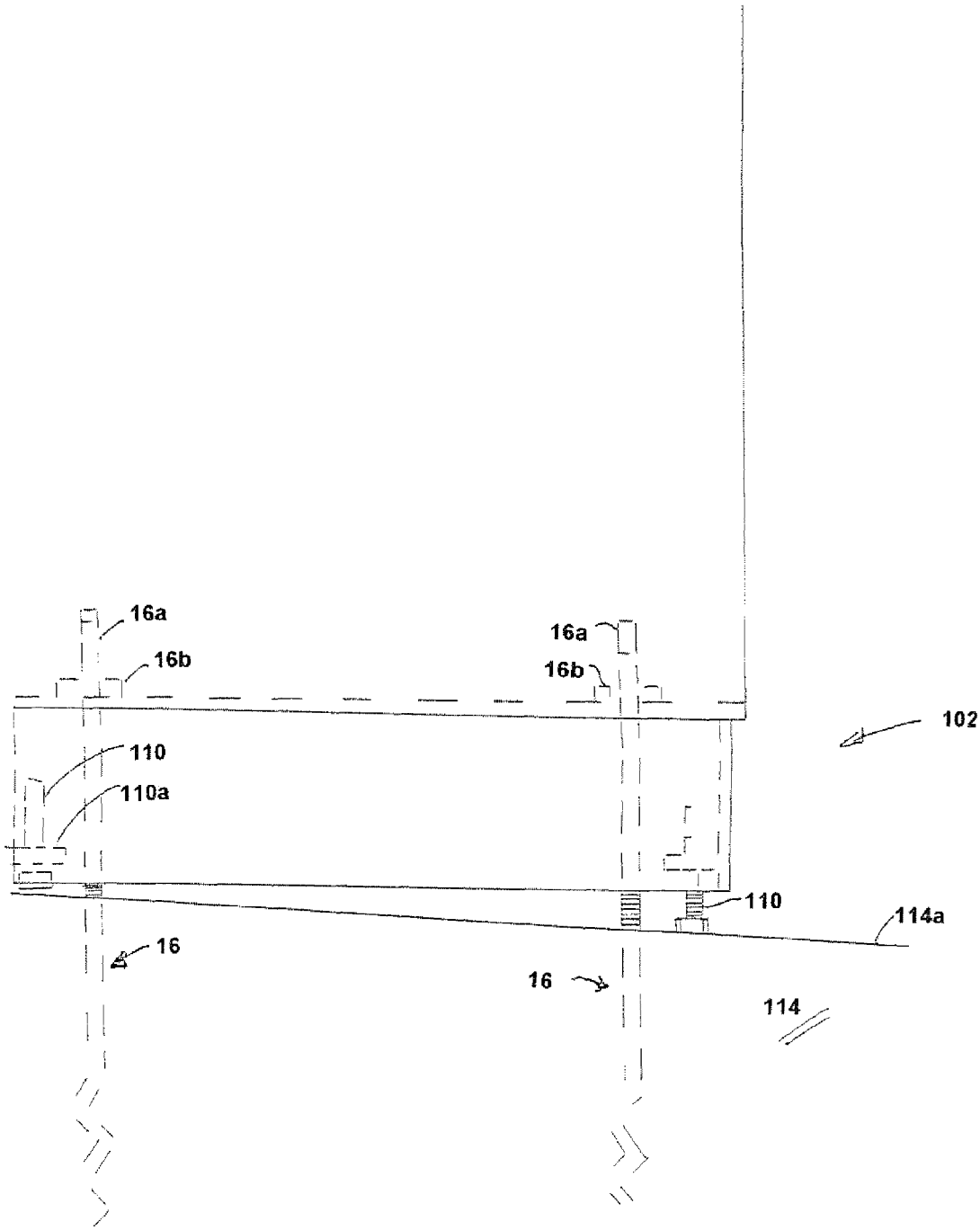
FIG. 10 is, a partially cut away side elevation view of the lower end of the pillar of FIG. 9.
Figure 11:
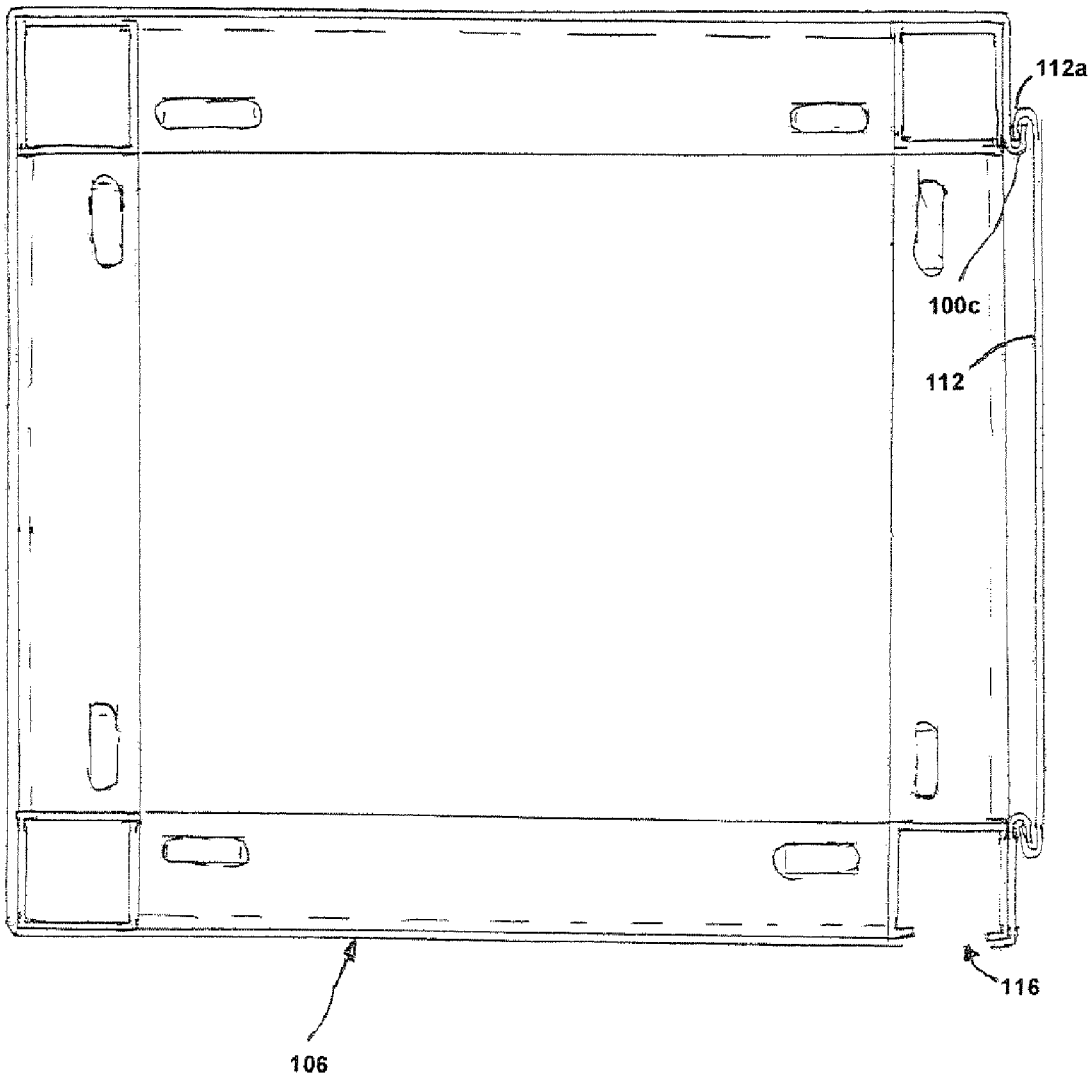
FIG. 11 is, in plan view, the upper end of the pillar housing of FIG. 9.
Figure 13A:
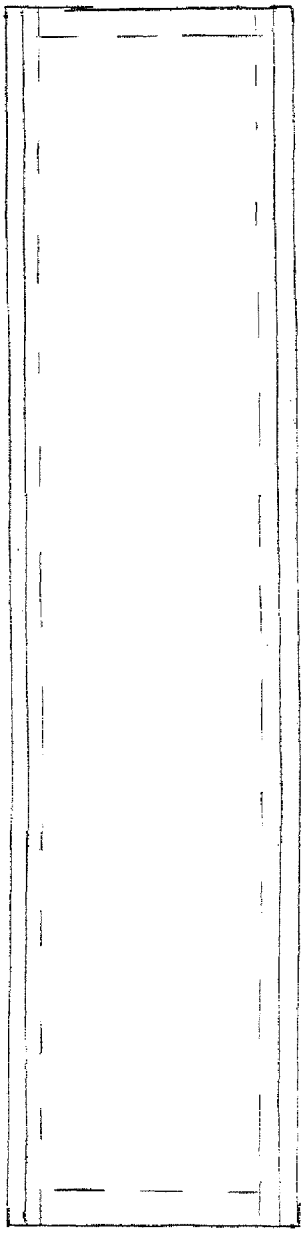
FIG. 13*a* is, in side elevation view, the right side of the pillar housing of FIG. 9 showing the removable door panel on the side of the pillar housing.
Figure 13B:
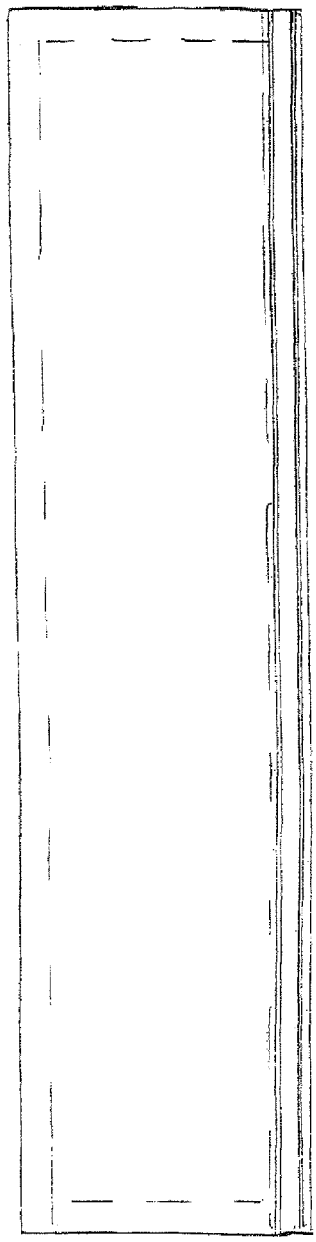
FIG. 13*b* is, in front elevation view, the pillar housing of FIG. 9 with the hinges and track covers removed.

In an alternative embodiment, and as seen commencing in FIG. 9, pillar 10 includes a symmetric and reversible pillar housing 100 adjustably mounted to base 102 and having a top cap 104. Housing 100 is hollow and is reversible in the sense that the oppositely disposed ends 100*a* and 100*b* are substantially identical and mirror images of one another so that they may be swapped end-for-end and mounted onto base 102. Thus, each end 100*a* and 100*b* of housing 100 includes a mounting flange 106 extending circumferentially around the open ends of housing 100. Both mounting flanges 106, that is, the mounting flange 106 on end 100*a* and the mounting flange 106 on end 100*b*, have mounting holes 108 in an identically spaced-apart mirror-imaged pattern around each flange 106.

Adjustable bolts 110 are mounted in the base 102 through the lower surface of the base, and in particular through the rigid floor 102*a* of base 102 so as to extend threaded upper ends of bolts 110 upwardly through floor 102*a*. Feet may be mounted on the lowermost ends of bolts 110 so as to engage the ground surface 114*a*. Threaded nuts 110*a* are mounted as by welding onto floor 102*a* so that the threaded ends of each bolt 110 may be threaded into the corresponding nut 110*a* so as to selectively vertically position the feet.

Ground anchors such as rods 16, or which include rods 16, are mounted in ground 114, with rods 16 protruding vertically upwardly. The threaded upper ends 16*a* of rods 16 extend from ground surface 114*a* and are inserted through corresponding anchor holes 108 in floor 102*a* and through corresponding mounting holes 106*a* in the flange 106 which has been positioned as the lower end of housing 100. Nuts 16*b* are threaded down onto ends 16*a* of rods 16 to clamp flange 106, and thus the housing 100, down onto the upper surfaces of base 102, in the illustrated embodiment defined by the upper edges of the base sidewalls 102*b*.

By pre-positioning the threaded ends of bolts 110 to thereby level base 102, the lower flange 106 will also be level and the housing vertical when the housing is mounted on base 102. In this fashion, if base 102 is mounted on a non-horizontal ground surface, the angular position of housing 100 and base 102 may be adjusted by the vertically adjusted positions of bolts 110 so that housing 100 is vertical.

A slideably mountable door 112, which may be made to resemble one of the pillar walls, slideably mounts onto housing 100 by the mating of longitudinally extending lips 112*a* under and along corresponding channels 100*e* formed in one open side of housing 100. Thus door 112 slides longitudinally onto and along the open side of housing 100 so as to selectively close the entire open side of housing 100 once the full length door 112 is slid into position. With cap 104 mounted down onto the uppermost end of housing 100, door 112 is locked into position on housing 100 so as to close over and camouflage the existence of the open side of housing 100.

The removable door 112 doubles as a decorative panel on the corner of the housing adjacent to the hinge track 116. Door 112 is mounted on vertical slides so as to make it inconspicuous. It is accessible by removing the cap 104. The pillar housing 100 is reversible so that it may be rotated about centroidal axis "X", "Y" or "Z" to bring the hinge location to the front, inside, back or upside down depending on the required hinge location relative to the base 102.

Mounting flanges 106 allow the pillar to be reversible end-for-end, that is, top to bottom and rotatable in 90 degree increments about axis X to cover the four most common hinge mounting locations, in a left hand or right hand configuration.

Vertical track 116 is formed near one of the corners into which threaded plate inserts 118 fit and slide up and down. Hinge bolts 118*a* are tightened to mount hinges 32 at their desired height along track 116, to thereby provide an adjustable height attachment point for the gate (not shown). With the hinges in position, covers 120 may be mounted to the uncovered portions of track 116 so as to make track 116 inconspicuous.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. An adjustable and reversible pillar comprising;

a reversible substantially rectangular parallelepiped pillar housing resting on a base, wherein said housing has opposite first and second ends which are substantially mirror images of one another, said first and second ends having corresponding first and second mounting flanges extending therearound, wherein said housing is hollow, having a cavity therein defined by pillar walls extending longitudinally between said first and second ends of said pillar, and wherein said mounting flanges each extend inwardly of said walls and into said cavity at corresponding said ends wherein at least one of said walls is selectively removable from said housing to provide access into said cavity when removed from said housing wherein either of said first or seconds ends is adapted for said mounting on said base, wherein said base has substantially parallel upper and lower surfaces, and wherein said upper surface is sized to mate with said first or second ends by mounting of corresponding said first or second mounting flanges onto said upper surface of base, vertically adjustable feet mounted to said lower surface of said base, a vertically adjustable hinge mounting assembly in one of said walls.

2. The pillar of claim 1 wherein said mounting flanges each have a plurality of mounting holes spaced theraround, and wherein said base has a corresponding plurality of ground anchor holes spaced around said base so as to cooperate with said plurality of mounting holes for journaling of ground anchors therethrough whereby upper ends of the ground anchors are securable down against the corresponding said mounting flange when resting down onto said upper surface of said base to thereby secure said housing down onto said base and said base down onto a ground surface from which said ground anchors protrude vertically upwardly.

3. The pillar of claim 2 wherein said hinge mounting assembly includes at least one track formed and extending longitudinally along said one of said walls.

4. The pillar of claim 3 wherein said at least one track is a single vertical track.

5. The pillar of claim 1 wherein said upper surface of said base is substantially square, and wherein a lateral cross-section through said first or second ends is also square and substantially correspondingly sized for flush mounting of said first or second mounting flanges down onto said upper surface of said base, whereby said housing is selectively positionable about a longitudinal centroidal axis of said housing, and reversible end-for-end so as to mount either said first or said second ends on said base.

6. The pillar of claim 5 wherein said hinge mounting assembly is offset to one lateral side of said one of said walls.

7. The pillar of claim 6 wherein said hinge mounting assembly is substantially along an edge of said one of said walls.

8. The pillar of claim 7 wherein said hinge mounting assembly includes a linear track for mounting hinges therein for selectively adjustable positioning therealong.

9. The pillar of claim 2 wherein said feet include vertically adjustable threaded male members for mating into correspondingly threaded female members mounted in said base.

10. The pillar of claim 2 further comprising the ground anchors, wherein said ground anchors include rods having upper and lower ends, said upper ends threaded and said lower ends adapted for mounting below ground level to resist tipping of said housing and wherein said upper ends of said rods journal through said holes and further comprising threaded nuts threadably mountable onto and along said upper ends of said rods so as to clamp said nuts down onto said first or second mounting flange when resting on said upper surface of said base, whereby corresponding said first or second ends are clamped down onto said base and said feet of said base clamped down onto said ground surface.

11. The pillar of claim 2 wherein said base is hollow, having side walls, an open top, and at least a partially enclosed floor defining said lower surface of said base, wherein said anchor holes in said lower surface are formed in said floor, and wherein upper edges of said side walls form at least part of said upper surface of said base.

* * * * *